US010507473B2

(12) United States Patent
Casa et al.

(10) Patent No.: US 10,507,473 B2
(45) Date of Patent: Dec. 17, 2019

(54) NOZZLE SEPARATOR BOWL

(71) Applicant: Andritz Frautech S.r.l., Schio (IT)

(72) Inventors: Daniele Casa, Schio (IT); Robert Chaffiotte, Madison, CT (US); Damon Cecchellero, Schio (IT); Ivan Holzer, Graz (AT); Valeria Motterle, Schio (IT); Diego Accelli, Schio (IT)

(73) Assignee: Andritz Frautech S.r.l., Schio (IT)

( * ) Notice: Subject to any disclaimer, the term of this patent is extended or adjusted under 35 U.S.C. 154(b) by 445 days.

(21) Appl. No.: 14/790,587

(22) Filed: Jul. 2, 2015

(65) Prior Publication Data

US 2016/0001301 A1 Jan. 7, 2016

(30) Foreign Application Priority Data

Jul. 4, 2014 (EP) ..... 14002297

(51) Int. Cl.
*B04B 7/08* (2006.01)
*B04B 11/00* (2006.01)

(52) U.S. Cl.
CPC ..... *B04B 7/08* (2013.01); *B04B 11/00* (2013.01)

(58) Field of Classification Search
CPC ..... B04B 1/12; B04B 11/00; B04B 7/08
USPC ..... 494/81, 43
See application file for complete search history.

(56) References Cited

U.S. PATENT DOCUMENTS

| | | | | |
|---|---|---|---|---|
| 2,060,239 A | | 11/1936 | Peutzer | |
| 2,654,535 A | * | 10/1953 | Davis | B04B 1/14 285/365 |
| 2,695,748 A | | 11/1954 | Millard | |
| 2,973,896 A | * | 3/1961 | Peltzer, Sr. | B04B 1/00 494/35 |
| 3,966,507 A | * | 6/1976 | Herbert | B04B 7/08 148/524 |
| 4,077,564 A | * | 3/1978 | Thylefors | B04B 1/18 494/26 |
| 4,943,273 A | * | 7/1990 | Pages | A61M 39/28 494/41 |
| 6,216,959 B1 | | 4/2001 | Garrison | |
| 7,614,995 B2 | | 11/2009 | Schulz | |
| 2010/0062923 A1 | * | 3/2010 | Mackel | B04B 1/12 494/56 |

FOREIGN PATENT DOCUMENTS

WO WO 2008058883 A1 * 5/2008 ..... B04B 1/12

* cited by examiner

*Primary Examiner* — Walter D. Griffin
*Assistant Examiner* — Shuyi S. Liu
(74) *Attorney, Agent, or Firm* — Alix, Yale & Ristas, LLP

(57) ABSTRACT

The invention relates to a centrifugal separator bowl (4) for a nozzle separator (1). It is primarily characterized in that the bowl (4) is manufactured from one single piece and has an interior comprising pyramidal wall openings (12) pointing to openings (10) for the nozzles (11). The invention further relates to a centrifugal separator (1) using such centrifugal separator bowl (4). With such design a treatment of suspensions with high specific gravity, including of up to 2.0 and beyond is possible.

12 Claims, 3 Drawing Sheets

NOZZLE SEPARATOR BOWL

BACKGROUND

The invention relates to a centrifugal separator bowl for a nozzle separator developed for high solids applications, including those up to about 2.0 specific gravity (SG). The invention further relates to a centrifugal separator using such a bowl.

A centrifugal separator consists of several stationary as well as rotating components. The feed pipe directs the separator feed, a solid/liquid mixture with high specific gravity, to an accelerator which directs the mixture into the rotating bowl. While the feed pipe is stationary, the accelerator and the bowl may rotate. In the separator bowl, the separator feed is separated, due to rotational forces, into two fractions. These two fractions leave the separator bowl either through the (rotating) disc stack, (stationary) centripedal pump, and (stationary) discharge pipe, as the so-called overflow, or through the nozzles at the outer bowl wall and the (stationary) cyclone, as the so-called underflow. Due to the rotational forces inside the bowl, the lighter fraction (lower specific gravity) is following the overflow path while the heavier fraction (higher specific gravity) is following the underflow path.

Centrifugal separators as they exist in the current state of the art, when provided with a feed of a mixture of high specific gravity, e.g., mineral suspensions up to 70% solids content, face the risk of material build-up in the bowl. This can result in machine vibration or, by exceeding the material strength of standard bowl material (e.g., duplex steel), a material failure.

Existing centrifugal bowls are manufactured in multiple parts or have separate inserts for directing the flow of the suspension to the nozzle openings. When a centrifuge operates at high speeds, such a split bowl may break apart. If there are inserts in the bowl, these may loosen during operation and may block openings. Loosened inserts may even lead to a break in the bowl, due to potential instability and increased vibrations from the unbalanced weight.

SUMMARY

The goal of the invention is to avoid the drawbacks of the state of the art and to provide beneficial fluid flow direction while maintaining strength and stability. The invention is thus characterized in that the bowl is manufactured from one single piece of material and has pyramidal openings pointing to the openings for the nozzles.

A further embodiment of the invention is characterized in that the openings for the nozzles have a recess at the outside of the bowl. This recess is arranged on the trailing side of the opening in relation to the rotation direction of the bowl.

Another advantageous embodiment of the invention is characterized by the manufacturing the bowl from martensitic material. Such material, among other benefits, allows for the processing of high specific gravity suspensions, such as those of up to 2.0 and beyond, without many common problems, such as increased wear or insufficient bowl strength for separation.

A further embodiment of the invention is characterized by the bowl being cast from one piece. By fabricating the bowl as a complete single piece, no loose parts, such as inserts, need to be present. Additionally, there is a significantly reduced risk of breakage or splitting due high forces caused by high revolution speeds, especially when separating suspensions with high specific gravity. It will be understood by one skilled in the art that the bowl can also be forged from one piece, sintered, or manufactured by other traditional and new manufacturing methods.

A further advantageous embodiment of the invention includes a smooth fluid flow path which begins at an inlet for the suspension to the bowl. This path continues to the openings for the nozzles, defining a smooth flow free of positions and features for deposition of material. With such a design, there are no lips or edges where material can build up. This allows for stable operation and enables the suspension to be directed from the inlet (into the bowl) to the outlet openings in an optimal way. Such an embodiment can also be designed so as to eliminate or minimized turbulence in the flow through to the nozzles.

The invention also relates to a centrifugal separator having a centrifugal separator bowl according to the invention.

BRIEF DESCRIPTION OF THE DRAWING

The invention is now disclosed in detail with reference to an exemplary embodiment shown in the accompanying drawing, where.

DETAILED DESCRIPTION

Figure 1:
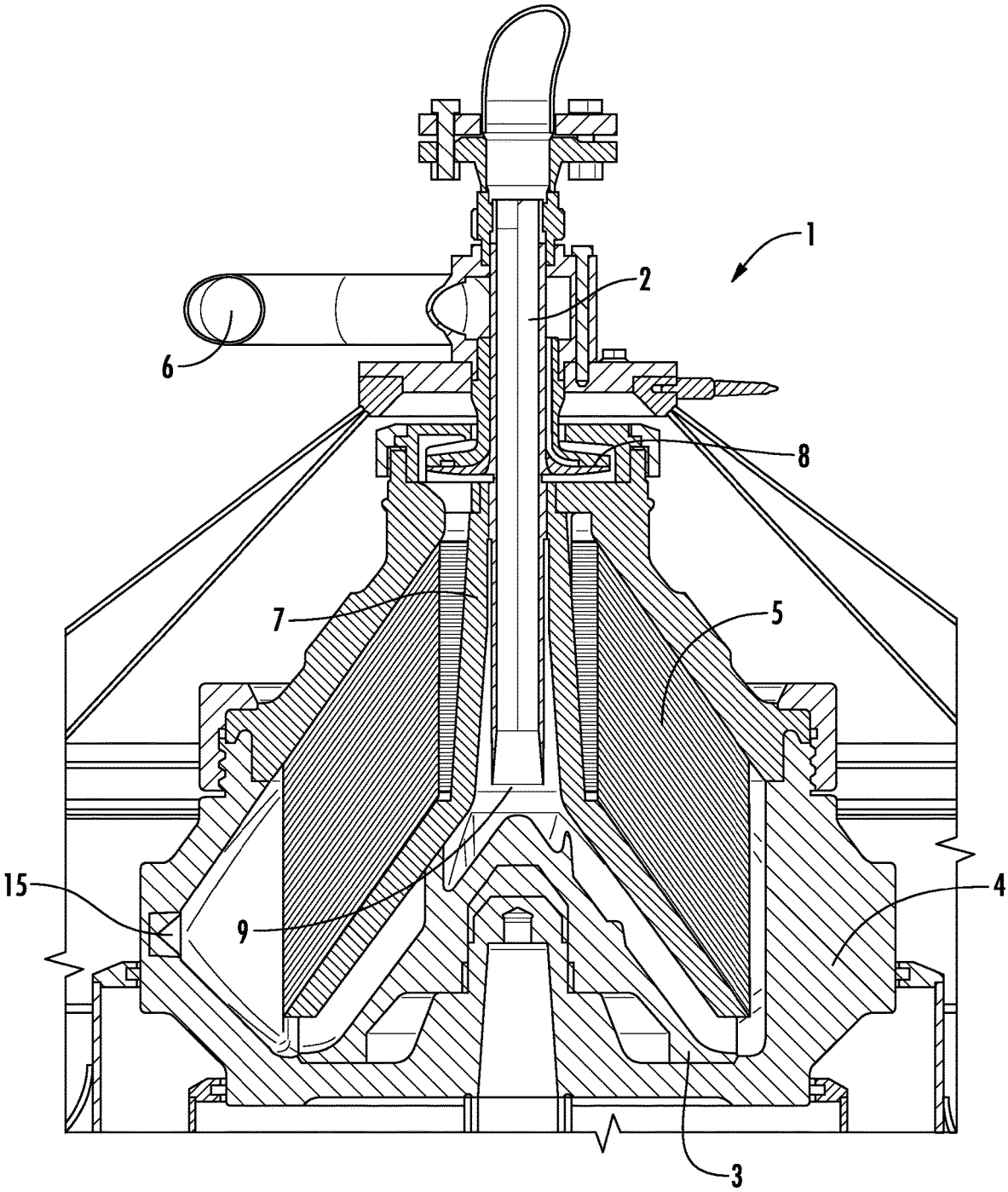
FIG. 1 shows a section of a nozzle separator where the invention is used.

FIG. 1 shows a nozzle separator 1 with a feed pipe 2 for the solid/liquid mixture. This mixture is directed to an accelerator 3 which directs the mixture to the free space in the rotating drum or bowl 4. The mixture is separated in the disc stack 5, with a heavier fraction discharged through nozzles (to be described in greater detail below) and a lighter fraction discharged through discharge pipe 6. Due to the rotation, the lighter fraction concentrates in the centre and the heavier fraction is sent to the circumference. The feed pipe 2, which introduces the suspension or mixture into the centrifugal separator, is arranged in the hollow shaft of the distributor 7 where the light fraction is pumped upwards by a centripetal pump 8 to the discharge pipe 6. The accelerator disc 3 is fixed to the separator bowl 4 and rotates with it.

Figure 2:
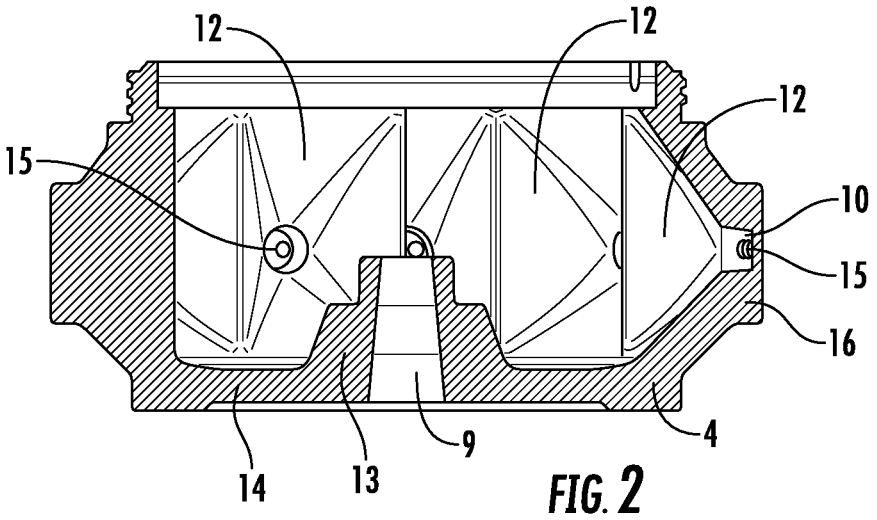
FIG. 2 shows a section of the separator bowl according to the invention, taken along line II-II of FIG. 3.

FIG. 2 shows a section of the separator bowl 4 according to the invention. The central hub 13 extends from the bowl bottom 14 with the opening 9 for the connection to the drive spindle (not shown). The bowl (drum) wall 16 defines a number of pyramidal wall openings 12, each pointing with its apex to a nozzle opening 10 into which a nozzle assembly 15 may be inserted. Based on the diameter, there can be a number of openings. Eight openings for nozzles are depicted, however this number may be smaller or, with greater diameters, even more than sixteen openings are possible. The number of wall openings 12 may also depend on the material to be separated, so as to create a smooth path free from lips or edges from the inlet to the nozzle openings 10, as well as the material from which the bowl 4 is manufactured. Due to the pyramidal design, the flow of the suspension is directed with minimized turbulence, and ideally none at all, from the accelerator disc 3 to the nozzles 15. Although pyramidal openings 12 have been found to be especially effective, it will be understood by one skilled in the art that other smoothly converging wall openings 12 may be suitable.

Figure 3:
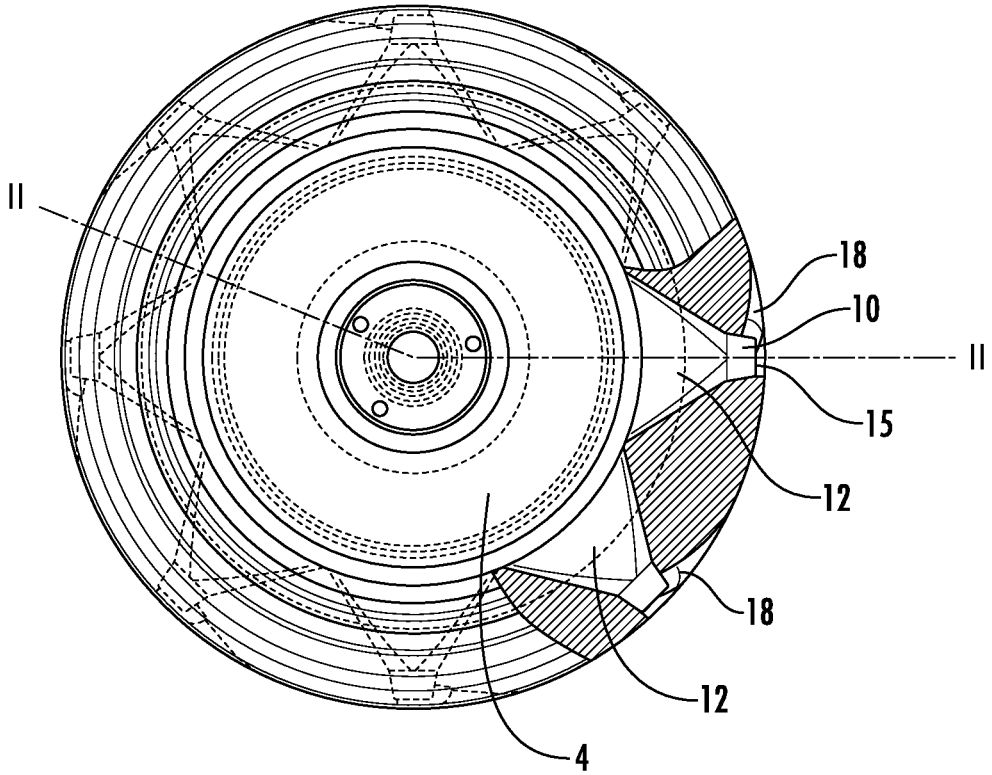
FIG. 3 shows a top view of the separator bowl with breakout section in the region of two nozzles.

FIG. 3 shows a breakout section of FIG. 1 at the level of the openings 10 for the nozzles. Eight pyramidal openings 12 of the bowl 4 are shown, however, as previously mentioned, this may differ due to the diameter of the bowl 4, rotational speed, properties of the suspension. These factors may also result in other angles of the openings 12. Each opening 12 points with its apex to an opening 10 for a nozzle assembly 15. Opening 10 has a channel or recess 18 at the outer circumference of the bowl 4 extending in the direction against the direction of rotation of the bowl 4, through which the nozzle (not shown in FIG. 3) is inserted into the nozzle assembly 15.

Figure 4:
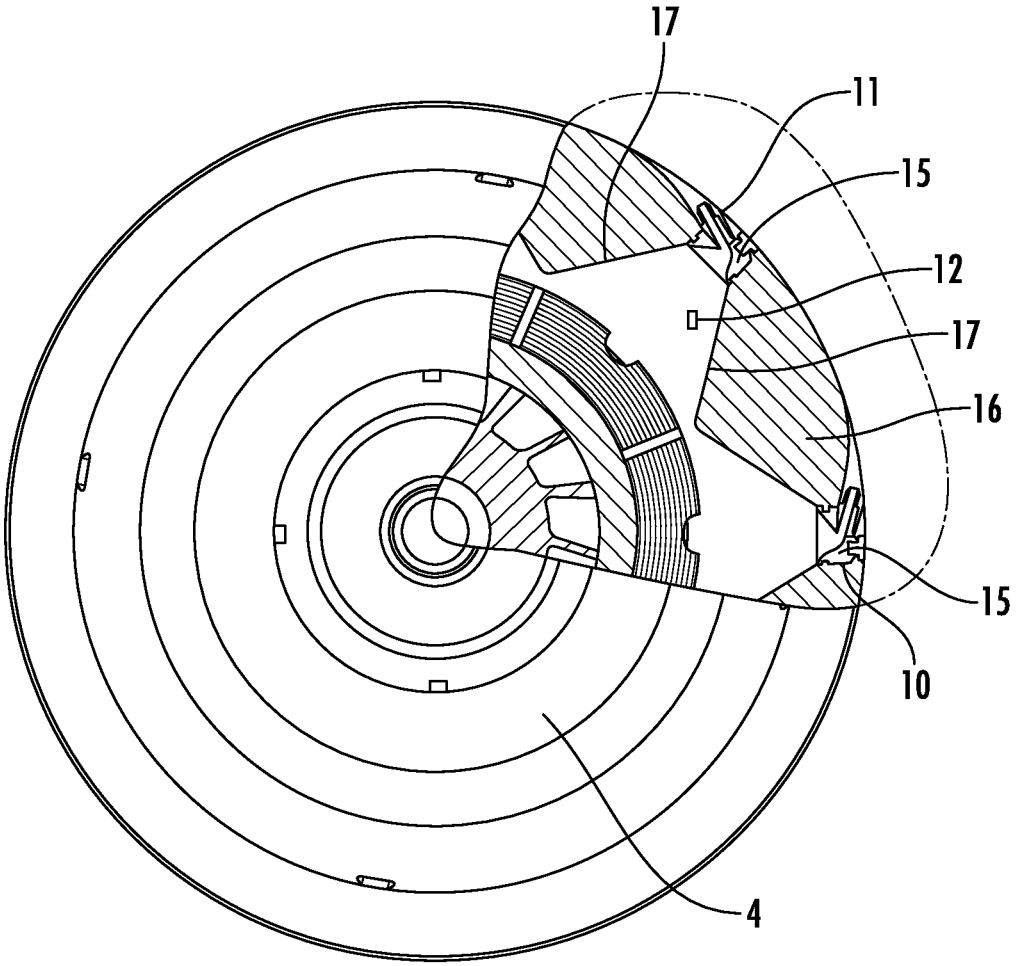
FIG. 4 shows a top view of the separator bowl with another breakout section in the region of two nozzles according to the invention.

FIG. 4 shows the arrangement of two nozzle assemblies 15 in a partial section through bowl 4. Here, it can be seen that the bowl wall 16 has pyramidal openings 12 which direct the suspension into the openings 10 of the nozzle assembly 15 by converging wall regions 17. Between the nozzles 11 and nozzle assembly 15 there is a solid part 17 of the bowl 4 so also to build a stable and strong bowl for the high revolutions (including up to 6000 rpm or higher).

As shown in FIGS. 2-4, the bowl 4 defines a path from its inlet for the suspension into the bowl 4 through each pyramidal opening 12 to the respective nozzle 11 that is free from lips and free from an intervening structure. This configuration allows a flow of suspension with solid particles from the inlet through the pyramidal openings 12 to the nozzles 11 with minimized turbulence and without passing through an intervening structure that removes solids from the suspension.

The invention claimed is:

1. Centrifugal nozzle separator, comprising a bowl (4) manufactured from one single piece and defining pyramidal openings (12) pointing to openings (10) for nozzles (11), wherein the bowl (4) with pyramidal openings (12) further defines a path from an inlet for a suspension into the bowl (4) through each pyramidal opening (12) to the openings (10) for the nozzles (11) that is free from lips and free from an intervening structure, configured to allow flow of a suspension with solid particles from the bowl (4) through the pyramidal openings (12) to the nozzles (11) with minimized turbulence and without passing through an intervening structure that removes solids from the suspension.

2. Centrifugal nozzle separator according to claim 1, wherein each of the openings (10) for the nozzles (11) has a recess at the outside of the bowl (4), which recess is arranged on a trailing side of the opening (10) seen in rotation direction of the bowl (4).

3. Centrifugal nozzle separator according to claim 1, wherein the bowl (4) is manufactured from martensitic material.

4. Centrifugal nozzle separator according to claim 1, wherein the bowl (4) is cast from one piece.

5. Centrifugal nozzle separator according to claim 1, wherein the bowl (4) is forged from one piece.

6. A centrifugal nozzle separator, comprising:

a bowl comprising an interior wall; and a plurality of radially outward extending pyramidal wall openings (12), each wall opening defined by smoothly converging portions of the interior wall to an apex configured to direct fluid flow to a respective nozzle opening (10) radially terminal to the respective pyramidal section in the bowl;

wherein the bowl (4) is manufactured as a single piece and defines a path from an inlet for a suspension into the bowl (4) through each pyramidal opening (12) to the respective nozzle (11) that is free from lips and free from an intervening structure, thereby allowing a flow of suspension with solid particles from the inlet through the pyramidal openings (12) to the nozzles (11) with minimized turbulence and without passing through an intervening structure that removes solids from the suspension.

7. Centrifugal nozzle separator according to claim 6, wherein each of the nozzle openings (10) further comprises a recess at the periphery of the bowl (4), and each recess is oriented on a trailing side of a respective nozzle opening (10) in relation to the rotation direction of the bowl (4).

8. Centrifugal nozzle separator according to claim 6, wherein the bowl (4) is manufactured from a martensitic material.

9. Centrifugal nozzle separator according to claim 6, wherein each of the nozzle openings (10) further comprises a recess at the periphery of the bowl (4), and each recess is oriented on a trailing side of a respective nozzle opening (10) in relation to the rotation direction of the bowl (4).

10. Centrifugal nozzle separator of claim 1, wherein the bowl defines a solid section (17) circumferentially between each nozzle (11).

11. Centrifugal nozzle separator of claim 6, wherein the bowl defines a solid section (17) circumferentially between each nozzle (11).

12. A centrifugal nozzle separator, comprising:

a feed pipe (2) defining an axis;

at least one rotatable accelerator disc (3) coaxial to and circumscribing the feed pipe (2); and a rotatable bowl (4) coaxial to the feed pipe (2) and the at least one accelerator disc (3), the bowl (4) comprising an interior wall with outwardly converging wall sections, the converging wall sections defining a plurality of pyramidal openings (12) with a radially terminal nozzle opening (10), the pyramidal openings (12) circumferentially aligned around the bowl, the bowl (4) with pyramidal openings (12) being made from a single piece, wherein a path is defined for direction of a flow of suspension with solid particles from the feed pipe through each pyramidal opening (12) to a respective nozzle opening (10), the path being free from lips and free from an intervening structure that removes solids from the suspension, thereby minimizing turbulence of the suspension with solid particles through each pyramidal opening (12) to the respective nozzle opening (10).

* * * * *